United States Patent [19]

Kavanagh et al.

[11] Patent Number: 4,507,801

[45] Date of Patent: Apr. 2, 1985

[54] PROTECTIVE GARMENT

[75] Inventors: Frank J. Kavanagh; James D. Plunkett; Bernard F. DePalma, all of Ithaca, N.Y.

[73] Assignee: Doc-K Protective Equipment, Inc., Ithaca, N.Y.

[21] Appl. No.: 415,678

[22] Filed: Sep. 7, 1982

[51] Int. Cl.[3] ..... A41D 13/00

[52] U.S. Cl. ..... 2/2; 2/267

[58] Field of Search ..... 2/22, 2, 23, 24, 267

[56] References Cited

U.S. PATENT DOCUMENTS 3,504,377 4/1970 Biggs et al. ..... 2/2

4,325,148 4/1982 Livernois ..... 2/22

OTHER PUBLICATIONS

Watkins, Susan M.; "The Design of Protective Equipment for Ice Hockey"; *Home Economics Research Journal;* Mar. 1977, vol. 5, No. 3, pp. 154–166.

Watkins, Susan M.; *Clothing–The Portable Environment;* "Designing Impact–Protective Clothing," pp. 91–107; Designing Mobility in Specialized Clothing and Equipment, pp. 171–175; Suspension Systems, pp. 204–205; ©1984, *Iowa State University Press.*

*Primary Examiner*—Louis K. Rimrodt

*Assistant Examiner*—J. L. Kravitz

*Attorney, Agent, or Firm*—Barnard & Brown

[57] ABSTRACT

A light, conforming protective garment for athletes made of a stretch material with pockets over the areas to be protected. Pads are formed to fit the wearer, inserted into the pockets, and are held closely in place by the stretch material.

9 Claims, 3 Drawing Figures

PROTECTIVE GARMENT

BACKGROUND OF THE INVENTION

The invention pertains to protective garments for athletes.

Many devices have been proposed and used in the past for protective pads and like apparatus for use by athletes, especially those in contact sports such as football and hockey. The shoulder pads currently used in such games, well known and familiar to the general public, are representative of the problems the prior art protective devices pose.

In general, the prior art pads are made of layers of heavy rigid material such as leather held on by straps. Although many changes have been made over the years, the basic design has remained the same. The weight of the pads leads to fatigue, and is uncomfortable. The rigidity of the material makes the pads liable to shift when hit, or when the athlete moves within the gear, leaving the wearer vulnerable. Because the surface of the pads is hard, they can cause injury to the members of the opposing team. Although some efforts have been made to alleviate this (see U.S. Pat. No. 3,146,461 issued to one of the inventors herein) the pads so made have met with little success.

It is thus an object of the invention to provide a protective garment which will provide adequate protection to an athlete, while being light in weight.

It is a further object of the invention to provide a protective garment which will be comfortable to wear.

It is a still further object of the inventor to provide a protective garment in which the padding will not shift, leaving the wearer unprotected.

The materials used in prior art pads have, in general, been in the form of rigid plates of set form, which fit haphazardly to the athlete's body. This lessens the protection available.

It is an object of the invention to provide a protective device which will conform to the body of the wearer.

Earlier designs tend to restrict the freedom of movement of the wearer. This is especially critical to quarterbacks in football, or hockey players in general. The pads are incapable of moving with the joint to be protected, if any attempt is made to protect the joints at all.

It is thus an object of the invention to provide a padded garment which will allow the wearer to move freely, while still providing adequate protection.

SUMMARY OF THE INVENTION

The invention provides a protective garment for athletes made of stretch material. Pockets on or in the garment hold pads, shaped to conform to the body of the athlete, firmly and accurately in position for minimum dislocation of the pads. The pads are preferably made of heat-formable plastic material which is lightweight and highly impact absorbent. The combination of lightweight, formed pads and a stretchable garment results in a comfortable protective device which will move with the athlete without unduly restricting his movements.

DESCRIPTION OF THE PREFERRED EMBODIMENT

Figure 1:
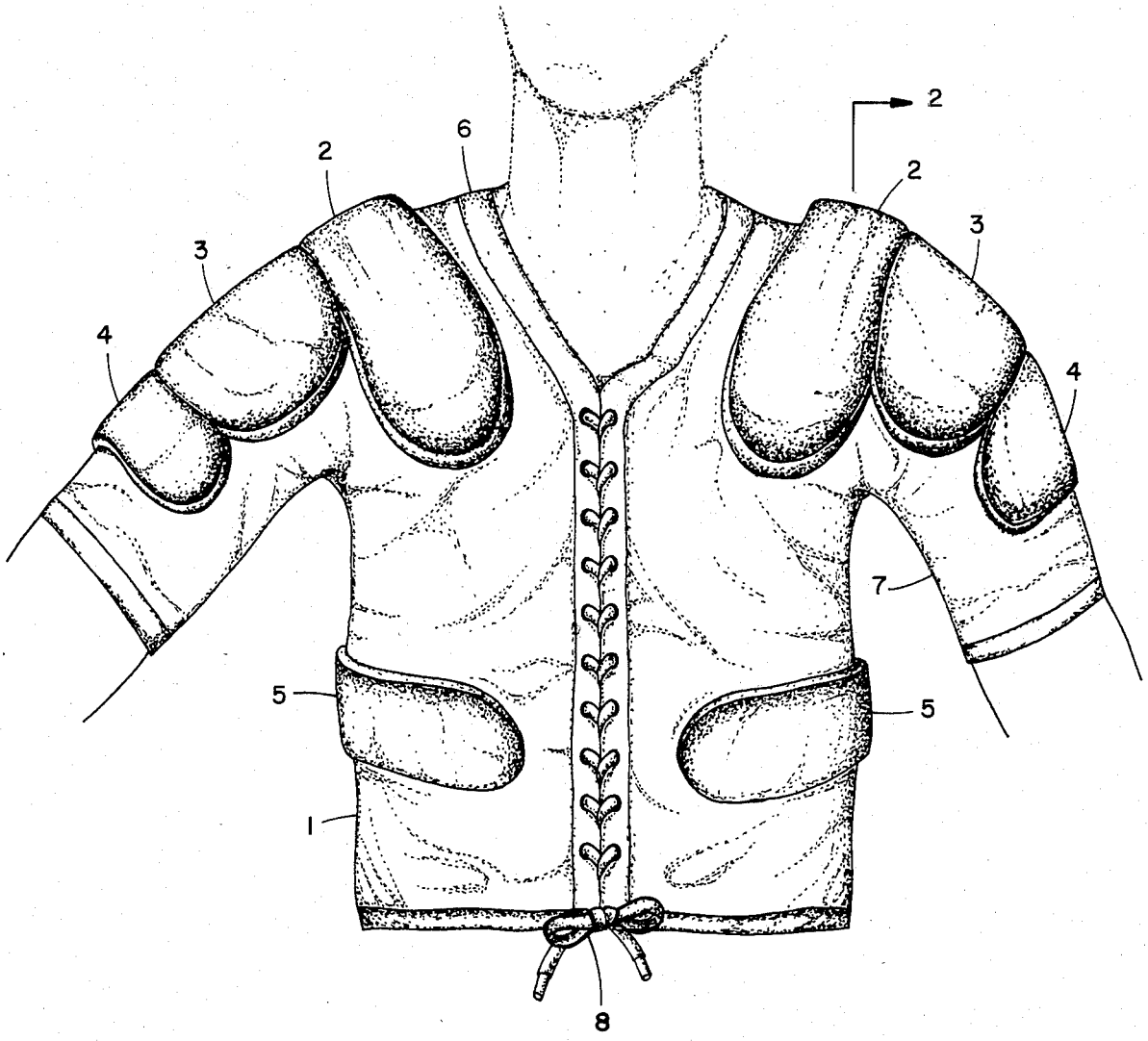
FIG. 1 shows a view of the preferred embodiment of the invention.

FIG. 1 shows the invention, in its preferred embodiment as a vest-like garment to be worn by an athlete competing in contact sports such as, for example, hockey or football.

The body of the invention is a shirt or vest (1) made of a stretchable material. We have found DuPont Lycra ® material to be especially suitable for this application because of its qualities of multiple-way stretchability and breathability. Other materials, however, may be substituted within the teachings of the invention. The vest may be made with half-sleeves as shown, or with longer or shorter sleeves, depending upon the areas of padding desired. The vest may be closed by or lacing, as shown, or by a zipper or Velcro ®, or may be simply made by a one-piece "slip-on" sweater type garment. A drawstring (8) may be provided to further fasten the vest in place.

A pocket is attached to the surface of the vest, preferably on the inside surface, over each area to be protected by padding. In the preferred embodiment, when designed, for example, as a hockey vest, the pockets are located at least over the acromio-clavicular joint area (2), and extended down and along the wearer's chest and back to cover at least part of the pectroal and upper trapezius muscles. Additional pockets (3) and (4) may be included to extend protection along the humerus and deltoid muscle. Additional pockets can be provided for rib protection (5). The shoulder area pockets could be slightly overlapped, as shown, or separate. The slight overlap is preferred as offering superior protection.

A pad of impact-absorbing material is fitted into each pocket (2)–(5). The pad is formed to the wearer's shape, in order to fit closely in position with a minimum of shifting. We have found that the best materials for this application are those which can be custom-molded at relatively low heat, such as materials currently used for lightweight splints and guards. An ideal material, at least in part, is a closed-cell polyethylene foam plastic such as BXL Plastazote TM, a nitrogen filled closed-cell, cross-linked polyethylene foam, which may be cut to shape, heated in an ordinary oven to 140° C. (250° F.) and then molded to the wearer. When cool, it will retain its shape. The pads may be inserted into and removed from the pockets easily. Thus, washing both the garment and the pads is made a simple matter.

Figure 3:
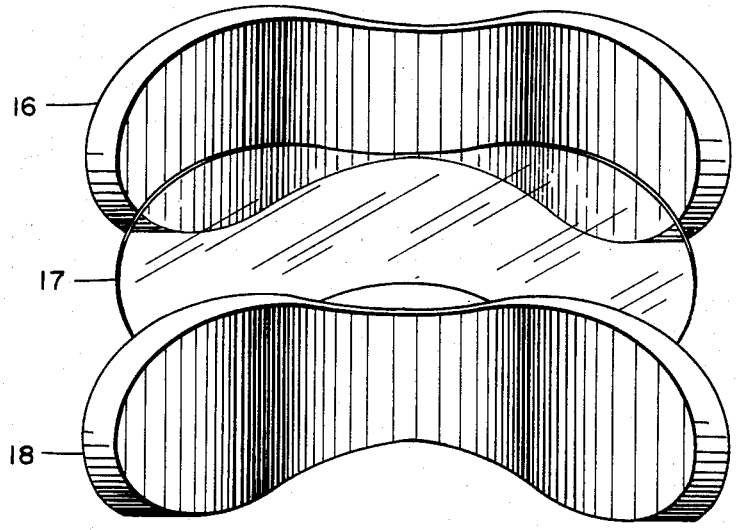
FIG. 3 shows the construction of the pads used in the preferred embodiment.

Although closed-cell foam such as Plastazote TM is very impact-absorbent (it is often used for gymnasium mats), and possess a considerable degree of rigidity when cool, we prefer to add a layer of rigid plastic for strength. FIG. 3 shows the preferred construction of a pad for use with the invention. The inner layer can be rigid plastic material such as Lexan TM or polyethylene plastic. Preferably, the rigid layer is a polycarbonate, such as Tuffak ®, heat moldable at 140° C. With such a material, a "sandwich" is made of a central layer of polycarbonate (17) surrounded by layers of closed cell foam (16) and (18), and heat molded as a unit. The polycarbonate provides rigidity while the foam absorbs impact. To an extent, the outer layer also saves to protect the opponent on impact, as well as the wearer. The combination material makes for a pad which is extremely lightweight, tough and washable.

Figure 2:
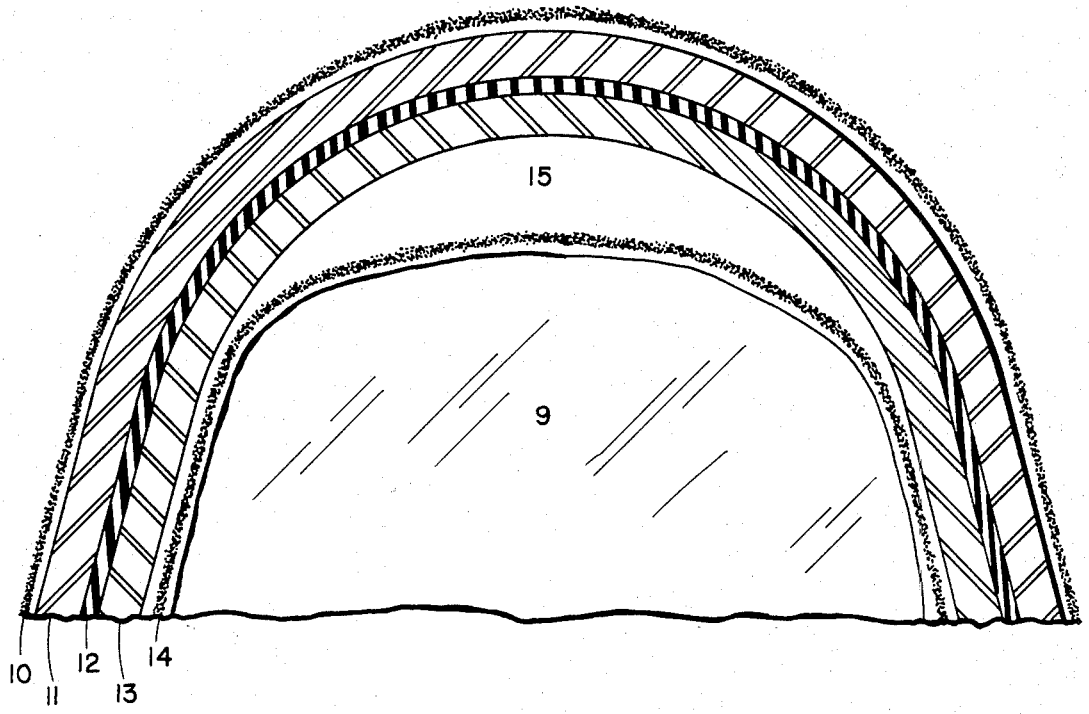
FIG. 2 shows a cut-away view of one part of the preferred embodiment.

As an alternative, a flexible non-heat formed foam, such as Ensolite®, could be attached to the heat formed rigid core, at a slight loss in effectiveness. FIG. 2 shows a cross-section (along line 2 on FIG. 1), of the shoulder pad (2) area, using the preferred 3 layer pad as described above. The rigidity of the polycarbonate core (12) permits the pad to "bridge" above the wearer's shoulder (9) joint, leaving a gap (15) and transferring impact force to the pectoral and trapezius muscles. The cloth of the vest (10) and pocket (14) conform closely to the outer layer of the pad (11) and wearer (9), respectively, holding the pad tightly in position by the vest and in place on the wearer. The "bridge" allows free movement of the shoulder joint.

For greater comfort, the pads could be provided with perforations, so that the pads can "breath", allowing perspiration to escape.

For football linemen, or other high-impact body contact situations, an additional pad could be provided on top of the others described. Other pad configurations would be possible for use with other sports within the teachings of the invention. A garment in the form of pants, with pockets and pads for thigh and knee protection, is also possible.

Accordingly, it is to be understood that the embodiments of the invention herein described are merely illustrative of the application of the principles of the invention. Reference herein to details of the illustrated embodiments are not intended to limit the scope of the claims which themselves recite those features regarded as essential to the invention.

We claim:

1. A protective garment for protecting at least the upper part of the body of an athlete comprising:

a. tightly fitting body-covering means made of stretchable material;

b. plurality of pockets affixed to the body covering means;

c. said pockets being located in the portion of the body-means covering the body portion to be protected;

d. a plurality of impact-absorbing pad means for protecting a body portion adapted to fit in the pocket means covering the body portion to be protected;

e. each pad means being shaped to conform to the contours of the wearer's body at the portion to be protected, whereby the pad means, fitting into the pocket means, protects a portion of the body by closely conforming to the body, held accurately in place by stretching of body covering means;

f. the garment having pocket means and pad means for insertion therein to cover and protect at least the acromio-clavicular joint of the shoulder;

g. said pocket means and pad means protecting the said acromio-clavicular joint of the shoulder extending downward to the wearer's pectoral and upper trapezius muscles, such that the pad means is bridged over the acromio-clavicular joint of the shoulder, leaving a gap between the top of the wearer's shoulder and the pad means, whereby impact forces are transferred to the pectoral and trapezius muscles, while allowing free movement of the shoulder.

2. The protective garment of claim 1 in which the pad means is made at least in part of material which may be formed while at a temperature higher than normal, and which retains the shape while at normal temperature, whereby the pad means may be molded to each wearer's body shape.

3. The protective garment of claim 2 in which the pad means comprise a rigid center layer of heat formable material covered with a plurality of layers of closed cell foam material.

4. The protective garment of claim 3 in which the rigid center layer is polycarbonate plastic.

5. The protective garment of claim 3 in which the rigid center layer is rigid polyethylene plastic.

6. The protective garment of claim 3 in which the closed cell foam material is heat moldable closed cell polyethylene foam plastic.

7. The protective garment of claim 1 further comprising pocket means and pad means located to protect the deltoid area.

8. The protective garment of claim 1 further comprising pocket means and pad means located to protect at least part of the rib area.

9. The protective garment of claim 1 further comprising pocket means and pad means located to protect at least part of the humerus area.

* * * * *